US010428724B2

(12) United States Patent
Honda et al.

(10) Patent No.: US 10,428,724 B2
(45) Date of Patent: Oct. 1, 2019

(54) COOLING DEVICE FOR INTERNAL COMBUSTION ENGINE

(71) Applicants: Toyota Jidosha Kabushiki Kaisha, Toyota-shi Aichi-ken (JP); Osaka Gas Co., Ltd., Osaka-shi Osaka (JP)

(72) Inventors: Akihiro Honda, Gotemba (JP); Saki Nakayama, Osaka (JP); Masahiko Matsumura, Kyoto (JP); Koichi Nishimura, Kyoto (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 29 days.

(21) Appl. No.: 15/927,593

(22) Filed: Mar. 21, 2018

(65) Prior Publication Data

US 2018/0274430 A1 Sep. 27, 2018

(30) Foreign Application Priority Data

Mar. 24, 2017 (JP) ..... 2017-059772

(51) Int. Cl.
*F01P 7/00* (2006.01)
*F01P 7/16* (2006.01)
(Continued)

(52) U.S. Cl.
CPC ..... *F01P 7/164* (2013.01); *F01P 3/20* (2013.01); *F15D 1/06* (2013.01); *F17D 1/16* (2013.01);
(Continued)

(58) Field of Classification Search
CPC ..... F01P 7/164; F01P 3/20; F01P 2025/04; F01P 2025/32; F01P 2025/40;
(Continued)

(56) References Cited

U.S. PATENT DOCUMENTS 3,961,639 A * 6/1976 Chang ..... F15D 1/06 137/13
2009/0133756 A1* 5/2009 Peysson ..... C25B 9/08 137/13
2019/0031938 A1* 1/2019 Kodama ..... C09K 5/10

FOREIGN PATENT DOCUMENTS

JP H11173146 A 6/1999

OTHER PUBLICATIONS

Nishimura, Koichi et al., "Prediction of drag reduction based on coherent fine scale eddies in turbulence", The Japan Society of Mechanical Engineers Article Collection (Part B), p. 311-317, vol. 68, No. 671 (Jul. 2002).

* cited by examiner

*Primary Examiner* — Hieu T Vo
*Assistant Examiner* — Sherman D Manley
(74) *Attorney, Agent, or Firm* — Dinsmore & Shohl LLP

(57) ABSTRACT

A cooling device for an internal combustion engine includes a circulation path, a coolant temperature sensor, a coolant pump, and an electronic control unit. The electronic control unit is configured to execute processing for performing feedback control on power of the coolant pump such that the output of the coolant temperature sensor becomes a target temperature, micelle determination processing for determining whether or not micelles are added to a coolant based on pump work of the coolant pump and the flow rate of the coolant flowing through the circulation path, Toms determination processing for determining whether or not the flow rate of the coolant satisfies a Toms effect expression condition, and correction processing for increasing a relative value of the output of the coolant temperature sensor with respect to the target temperature when the micelles is added and the Toms effect expression condition is established.

7 Claims, 11 Drawing Sheets

(51) Int. Cl.

| | |
|---|---|
| ***F15D 1/06*** | (2006.01) |
| ***F01P 3/20*** | (2006.01) |
| ***F17D 1/16*** | (2006.01) |
| *F01P 7/14* | (2006.01) |

(52) U.S. Cl.
CPC ..... *F01P 2007/146* (2013.01); *F01P 2025/04* (2013.01); *F01P 2025/06* (2013.01); *F01P 2025/32* (2013.01); *F01P 2025/40* (2013.01)

(58) Field of Classification Search
CPC ... F01P 2025/06; F01P 2007/146; F17D 1/16; F15D 1/06
See application file for complete search history.

COOLING DEVICE FOR INTERNAL COMBUSTION ENGINE

CROSS-REFERENCE TO RELATED APPLICATIONS

This application claims priority to Japanese Patent Application No. 2017-059772 filed on Mar. 24, 2017, which is incorporated herein by reference in its entirety including the specification, drawings and abstract.

BACKGROUND

1. Technical Field

The present disclosure relates to a cooling device for an internal combustion engine and, more particularly, to a cooling device suitable for cooling an internal combustion engine mounted in a vehicle.

2. Description of Related Art

Japanese Unexamined Patent Application Publication No. 11-173146 (JP 11-173146 A) discloses a cooling device for an internal combustion engine. The device has a circulation path allowing a coolant to circulate through the internal combustion engine. A coolant pump for coolant circulation is provided into the circulation path.

A coolant containing a surfactant is used in the cooling device disclosed in JP 11-173146 A. The surfactant is adjusted such that a plurality of rod micelles forms a macrostructure under a predetermined condition. Once the rod micelles form the macrostructure, the turbulent frictional resistance of a fluid is reduced and the pressure loss of the coolant is reduced.

The power that is needed for driving the coolant pump decreases as the pressure loss of the coolant decreases. Accordingly, in the cooling device disclosed in JP 11-173146 A, the amount of the energy that is consumed by the coolant pump can be smaller than in a cooling device using a coolant containing no micelle.

Usually, in a cooling device for an internal combustion engine, feedback control is performed on a coolant flow rate such that a coolant temperature reaches a target temperature. In a cooling device using an electric coolant pump, for example, a coolant temperature sensor is installed inside a coolant circulation path. When the temperature that is detected by the coolant temperature sensor exceeds the target temperature, the discharge amount from the coolant pump is increased. When the temperature that is detected by the coolant temperature sensor is lower than the target temperature, the discharge amount from the coolant pump is decreased.

The coolant circulation amount increases first once the pressure loss of the coolant is reduced in the cooling device disclosed in JP 11-173146 A. Once the coolant temperature falls below the target temperature as a result, the coolant flow rate is decreased by the feedback control described above. As a result, the coolant temperature continues to be controlled in the vicinity of the target temperature.

SUMMARY

Under a condition in which the pressure loss of the micelle-containing coolant is reduced, the heat transfer coefficient of the coolant is reduced at the same time. When the heat transfer coefficient is reduced, the amount of heat that the coolant receives from the internal combustion engine decreases. Accordingly, once the heat transfer coefficient of the coolant is reduced under an environment in which feedback control is performed on the coolant temperature, the amount of heat that is delivered from the internal combustion engine to the coolant becomes insufficient and the temperature of the internal combustion engine is shifted to a high temperature side.

The disclosure provides a cooling device for an internal combustion engine that is capable of maintaining the temperature of the internal combustion engine at a moderate temperature at all times while the cooling device uses a coolant containing micelles reducing a pressure loss under a specific condition.

A first configuration of an aspect of the disclosure relates to a cooling device for an internal combustion engine. The cooling device includes a circulation path for a coolant, the circulation path including a water jacket of the internal combustion engine, a coolant temperature sensor disposed on the circulation path, the coolant temperature sensor being configured to detect a coolant temperature, a coolant pump disposed on the circulation path, and an electronic control unit configured to control the coolant pump based on an output of the coolant temperature sensor. The electronic control unit is configured to execute processing for performing feedback control on power of the coolant pump such that the output of the coolant temperature sensor becomes a target temperature, micelle determination processing for determining whether or not micelles are added to the coolant based on pump work of the coolant pump and a flow rate of the coolant flowing through the circulation path, Toms determination processing for determining whether or not the flow rate satisfies a Toms effect expression condition, and correction processing for increasing a relative value of the output of the coolant temperature sensor with respect to the target temperature when the micelles is added and the Toms effect expression condition is established.

In the cooling device according to a second configuration of the aspect of the disclosure, the correction processing may include processing for correcting the output of the coolant temperature sensor to a high temperature side based on the flow rate of the coolant.

In the cooling device according to a third configuration of the aspect of the disclosure, the correction processing may include processing for correcting the target temperature to a low temperature side based on the flow rate of the coolant.

The cooling device according to a fourth configuration of the aspect of the disclosure may further include a power source configured to supply a voltage to the coolant pump, a current sensor configured to detect a current flowing through the coolant pump, and, a flow rate sensor disposed on the circulation path. The electronic control unit may be configured to calculate the pump work based on the output of the current sensor and calculate the flow rate of the coolant based on an output of the flow rate sensor.

The cooling device according to a fifth configuration of the aspect of the disclosure may further include a power source configured to supply a voltage to the coolant pump, a current sensor configured to detect a current flowing through the coolant pump, and a differential pressure sensor configured to detect a differential pressure ahead of and behind the coolant pump. The electronic control unit may be configured to calculate the pump work based on the output of the current sensor and calculate the flow rate of the coolant based on the pump work and the output of the differential pressure sensor.

In the cooling device according to a sixth configuration of the aspect of the disclosure, the micelle determination processing may include the micelle determination processing may include processing for detecting a rotation speed of the coolant pump, processing for calculating a reference value of the pump work based on the rotation speed of the coolant pump and the output of the coolant temperature sensor, and processing for calculating a reference value of the flow rate based on the rotation speed of the coolant pump and the output of the coolant temperature sensor. The electronic control unit may be configured to determine that the micelles are added to the coolant when the pump work is equal to or higher than the reference value of the pump work and the flow rate of the coolant is equal to or higher than the reference value of the flow rate of the coolant.

The cooling device according to a seventh configuration of the aspect of the disclosure may further include a first heat exchange device for a heater, the first heat exchange device being provided in the circulation path, a second heat exchange device provided into the circulation path in parallel to the first heat exchange device, and a valve configured to distribute the coolant flowing through the circulation path to each of the first heat exchange device and the second heat exchange device, and change a ratio of the distribution to each of the first and second heat exchange devices. The electronic control unit may be configured to further execute processing for determining a presence or absence of a heater request, processing for controlling the valve into a first mode in which an amount of the distribution to the first heat exchange device has a first priority when the heater request is present, and processing for controlling the valve into a second mode in which the distribution to the second heat exchange device takes priority over the distribution to the first heat exchange device when the heater request is absent.

According to the first configuration of the aspect of the disclosure, the state of the coolant can be determined based on the pump work and the flow rate of the coolant. Specifically, when the pump work exceeds the reference value and the flow rate of the coolant exceeds the reference value, the flow rate with respect to a viscosity of the coolant is higher, and thus a determination can be made that micelles are added to the coolant. The micelle-added coolant expresses the Toms effect when the flow rate satisfies a specific condition. In the first configuration of the aspect of the disclosure, whether or not the Toms effect expression condition is satisfied can be determined based on the flow rate of the coolant. Once the Toms effect is expressed, the pressure loss of the coolant is reduced and the heat transfer coefficient of the coolant is reduced at the same time. In the first configuration of the aspect of the disclosure, the output of the coolant temperature sensor is relatively raised when micelles are added to the coolant and the Toms effect expression condition is established. When the relatively raised output exceeds the target temperature, the flow rate of the coolant is increased by the feedback control. Once the coolant flow rate is increased when the heat transfer coefficient of the coolant is reduced by the Toms effect, the decrement of the heat receiving amount of the coolant is compensated for. Therefore, according to the first configuration of the aspect of the disclosure, the temperature of the internal combustion engine can be maintained at a moderate temperature even under a condition in which the micelle-added coolant expresses the Toms effect.

According to the second configuration of the aspect of the disclosure, the output of the coolant temperature sensor is corrected to the high temperature side. In the correction processing described above, the output of the coolant temperature sensor is corrected based on the flow rate of the coolant. A reduction in heat transfer coefficient resulting from the Toms effect correlates with the time scale of a micro vortex in a fluid. The time scale of the micro vortex in a fixed pipeline correlates with the flow rate of the fluid. An increment of the coolant needed to supplement a decrease in heat receiving amount attributable to the Toms effect correlates with the amount of reduction in heat transfer coefficient. A needed increment correlates with a correction amount applied to the output of the coolant temperature sensor. Accordingly, the correction amount that should be applied to the sensor output to compensate for the decrease in heat receiving amount correlates with the flow rate of the coolant. Therefore, according to the second configuration of the aspect of the disclosure, the output of the coolant temperature sensor can be corrected such that the influence of the Toms effect on the heat receiving amount of the coolant can be appropriately compensated for.

According to the third configuration of the aspect of the disclosure, the target temperature is corrected to the low temperature side. According to the third configuration of the aspect of the disclosure, the correction for appropriately compensating for the heat receiving amount decrement can be applied to the target temperature by the flow rate being the basis of the correction as in the case of the second configuration of the aspect of the disclosure.

According to the fourth configuration of the aspect of the disclosure, the pump work can be accurately calculated based on the current flowing through the coolant pump. In the fourth configuration of the aspect of the disclosure, the cooling device is provided with the flow rate sensor, and thus the flow rate of the coolant can be accurately calculated based on the output of the flow rate sensor.

According to the fifth configuration of the aspect of the disclosure, the pump work can be accurately calculated as in the case of the fourth configuration of the aspect of the disclosure. In addition, in the fifth configuration of the aspect of the disclosure, the cooling device is provided with the differential pressure sensor, and thus the differential pressure ahead of and behind the coolant pump can be accurately detected. The flow rate of the coolant can be calculated by the pump work being divided by the differential pressure ahead of and behind the coolant pump. Therefore, according to the fifth configuration of the aspect of the disclosure, the flow rate of the coolant can be accurately calculated as well.

According to the sixth configuration of the aspect of the disclosure, the reference value of the flow rate of the coolant and the reference value of the pump work can be calculated based on the rotation speed of the coolant pump and the output of the coolant temperature sensor. A determination is made that the flow rate of the coolant is high with respect to the viscosity of the coolant when the rotation speed of the coolant pump is equal to or higher than the reference value and the flow rate of the coolant is equal to or higher than the reference value of the flow rate of the coolant. Occurrence of this situation with regard to the coolant is limited to a case where micelles are added. Therefore, according to the sixth configuration of the aspect of the disclosure, the presence or absence of micelle addition can be accurately determined.

According to the seventh configuration of the aspect of the disclosure, the coolant flowing through the circulation path can be preferentially distributed to the first heat exchange device for a heater when the heater request is present. The heater request is likely to be made at a low temperature. The micelle-containing coolant is likely to express the Toms effect at a low temperature. In other words, the heat transfer coefficient of the micelle-containing coolant is likely to be reduced at a low temperature at which the heater request is likely to be made. According to the seventh configuration of the aspect of the disclosure, a sufficient heating effect can be achieved even under this situation by the coolant being preferentially distributed to the first heat exchange device for a heater. According to the seventh configuration of the aspect of the disclosure, the coolant is preferentially distributed to the second heat exchange device when the heater request is absent. In this case, wasting of the heat capacity of the coolant by the first heat exchange device for a heater can be effectively prevented.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

First Embodiment

Configuration of First Embodiment

Figure 1:
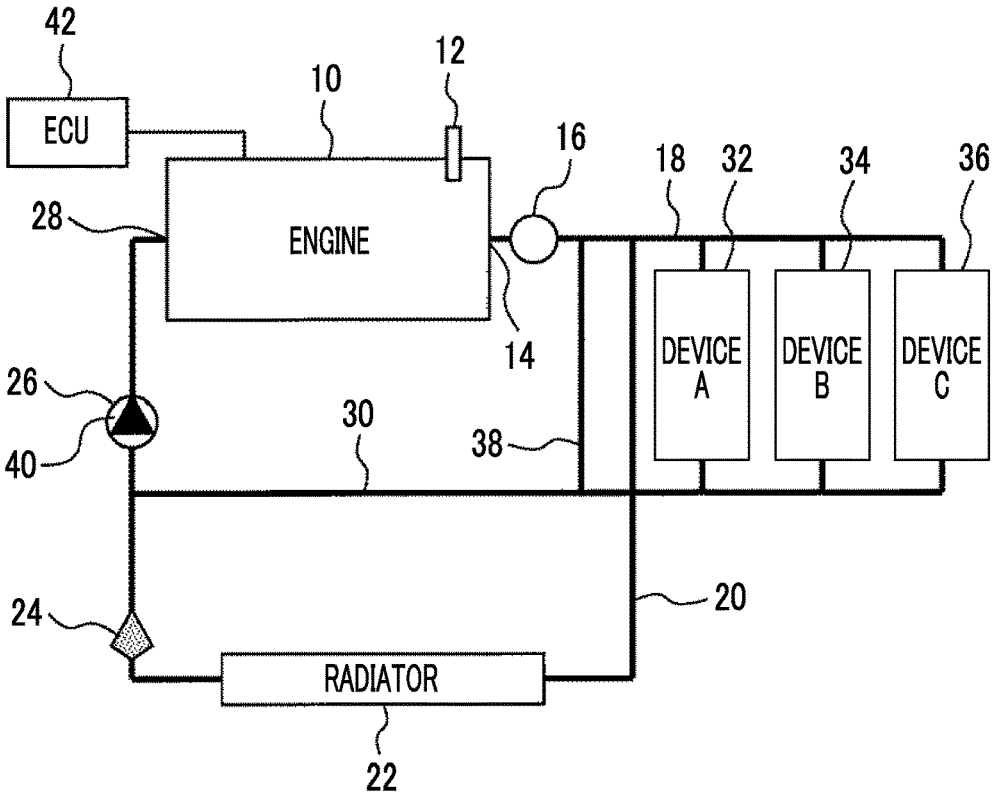
FIG. 1 is a diagram illustrating a configuration of a cooling device according to a first embodiment.

FIG. 1 shows a configuration of a cooling device according to a first embodiment. A water jacket for coolant circulation is disposed inside an internal combustion engine 10 illustrated in FIG. 1. The internal combustion engine 10 is provided with a coolant temperature sensor 12. The coolant temperature sensor 12 is capable of detecting the temperature of a coolant flowing through the water jacket of the internal combustion engine 10.

An outflow port 14 of the water jacket communicates with a circulation path 18 via a flow rate sensor 16. The flow rate sensor 16 is capable of detecting the flow rate of the coolant circulating inside the water jacket. The circulation path 18 has a radiator path 20. A radiator 22 and a thermostat 24 are disposed in series on the radiator path 20. The thermostat 24 communicates with a suction port of a coolant pump 26. A discharge port of the coolant pump 26 communicates with an inflow port 28 of the water jacket of the internal combustion engine 10.

The circulation path 18 has a device path 30 in addition to the radiator path 20. A plurality of devices for performing heat exchange with the coolant is provided and the devices are disposed in parallel on the device path 30. In the first embodiment, three devices illustrated in FIG. 1 are as follows, respectively.

Device A=Heat exchange device 32 for heater

Device B=Transmission oil warmer 34

Device C=Oil cooler 36

The heat exchange device 32 for a heater is a heat source for providing hot air into a vehicle cabin. The transmission oil warmer 34 is a heat source for heating a transmission oil. The oil cooler 36 is a cooler for cooling a lubricant for the internal combustion engine 10.

The device path 30 is provided with a bypass passage 38 disposed in parallel to the devices described above. Each of the three devices 32, 34, 36 and the bypass passage 38 disposed in parallel to one another communicates with the suction port of the coolant pump 26.

The coolant pump 26 is an electric pump. A voltage is supplied to the coolant pump 26 by duty control from an electric power source such as a battery. The coolant pump 26 is capable of changing pump work in accordance with a command supplied from the outside. The coolant pump 26 has a built-in current sensor 40 for detecting a current flowing through the coolant pump 26.

Figure 2:
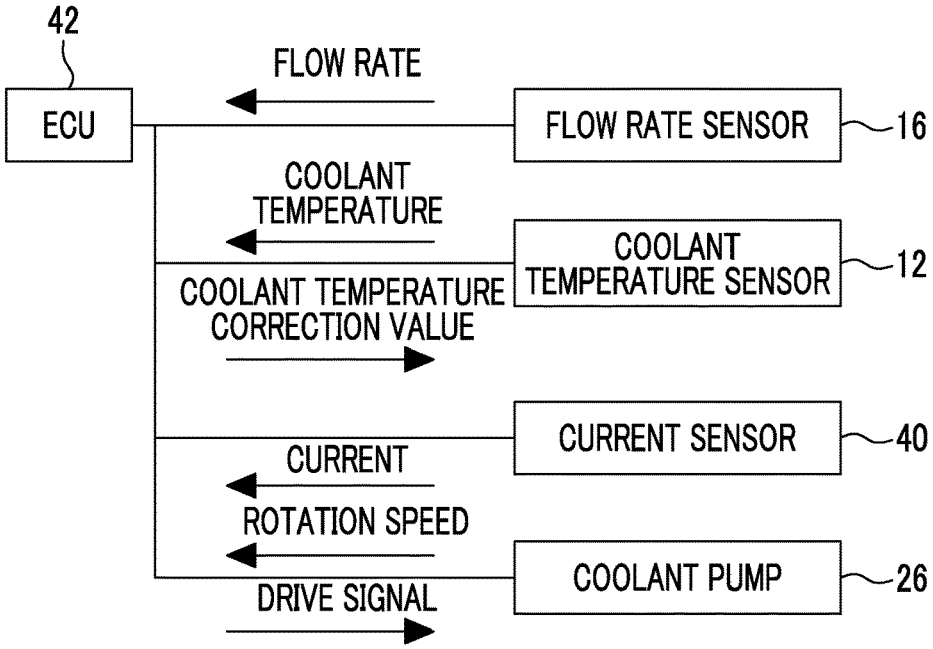
FIG. 2 is a diagram illustrating a configuration of a cooling system of the cooling device according to the first embodiment.

FIG. 2 shows a configuration of a control system of the cooling device illustrated in FIG. 1. The cooling device according to the first embodiment is provided with an electronic control unit (ECU) 42. The ECU 42 is capable of detecting the flow rate of the coolant flowing through the circulation path 18 based on the output of the flow rate sensor 16 described above. In addition, the ECU 42 is capable of detecting the temperature of the coolant in the water jacket based on the output of the coolant temperature sensor 12 described above. Furthermore, the ECU 42 is capable of detecting the current flowing through the coolant pump 26 based on the output of the current sensor 40 described above. Moreover, the ECU 42 is capable of supplying a drive signal with respect to the coolant pump 26 and receiving a signal representing the rotation speed of the pump from the coolant pump 26.

In the first embodiment, the ECU 42 performs feedback control on the coolant pump 26 based on the output of the coolant temperature sensor 12 such that the temperature of the internal combustion engine 10 is kept at a moderate temperature. Specifically, the feedback control is performed on the coolant flow rate such that the output of the coolant temperature sensor 12 becomes a target temperature (such as 90° C.). According to the control, the coolant flow rate increases when the output of the coolant temperature sensor 12 exceeds the target temperature. When the coolant flow rate increases, the amount of heat delivered from the internal combustion engine 10 to the coolant increases. As a result, the temperature of the internal combustion engine 10 drops. In addition, the temperature of the coolant drops. The coolant flow rate decreases when the output of the coolant temperature sensor 12 is below the target temperature. When the coolant flow rate decreases, the amount of heat delivered from the internal combustion engine 10 to the coolant decreases. As a result, the temperature of the internal combustion engine 10 rises. Soon, the temperature of the coolant rises. By the above being repeated, the temperature of the coolant is maintained in the vicinity of the target temperature and the temperature of the internal combustion engine 10 is appropriately controlled.

Characteristics of Coolant

The coolant used in the first embodiment contains a surfactant. More specifically, the coolant used in the first embodiment contains micelles formed by gathering of a plurality of molecules constituting a surfactant. The surfactant is similar to, for example, the surfactant that is disclosed in JP 11-173146 A. The surfactant expresses the Toms effect under a specific condition. The "Toms effect" is a phenomenon in which the pressure loss (liquid friction resistance) of a turbulent flow significantly drops under a specific condition when a small amount of polymer is added to a liquid.

Figure 3:
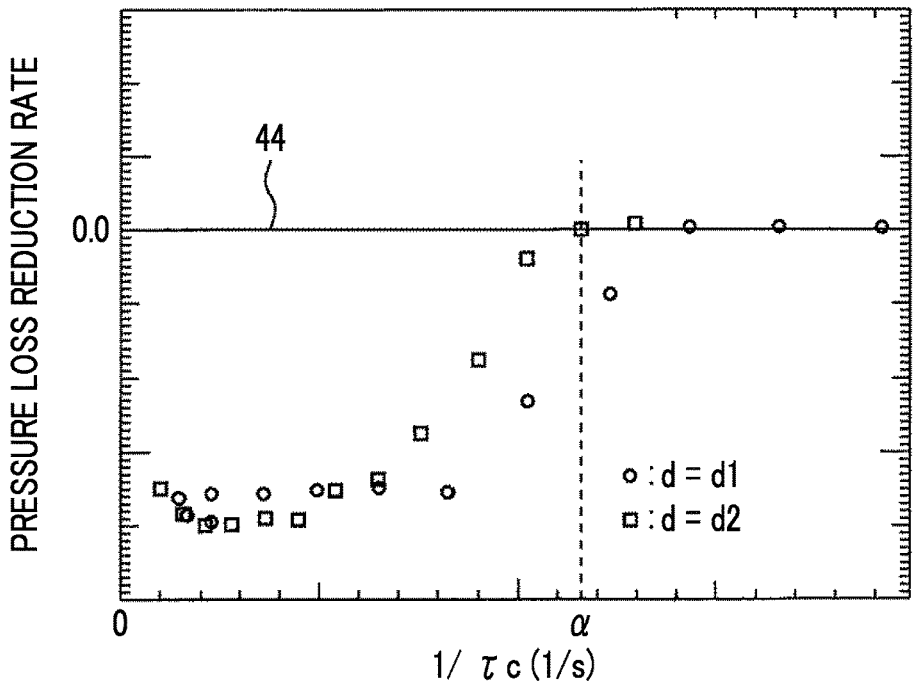
FIG. 3 is a graph for showing a reduction in a pressure loss of a coolant resulting from expression of the Toms effect.

FIG. 3 is a graph for showing a reduction in the pressure loss of the coolant resulting from the expression of the Toms effect. The pressure loss is generated when the coolant flows through a pipeline. The pressure loss of the coolant used in the first embodiment shows the change that is illustrated in FIG. 3 due to the Toms effect expressed under a specific condition.

The vertical axis of FIG. 3 represents a pressure loss reduction rate. A base 44 noted in "0.0" of the vertical axis corresponds to the pressure loss of a coolant containing no surfactant. The horizontal axis of FIG. 3 represents Toms effect expression index "1/τc". τc represents the time scale of a micro vortex generated in a fluid and is expressed by the following equation (refer to, for example, "Frictional Resistance Reduction Effect Prediction Method Based on Turbulent Flow Coherent Micro Vortex", Vol. 68, No. 671 (2002-7), Japan Society of Mechanical Engineers Article Collection (Part B)).

$$\tau c = 1.95 * 10^{-2} * \langle u \rangle^{-7/4} * d^{1/4} \quad (1)$$

In Equation (1) above, <u> is the sectional average velocity of the fluid in the pipeline, and d is the pipe diameter of the pipeline. Once the physical shape of the circulation path 18 is determined, the sectional average velocity is a function of flow rate. Accordingly, the value <u> can be calculated based on the output of the flow rate sensor 16. In addition, the pipe diameter d can be identified once the shape of the circulation path 18 is determined. Therefore, the τc can be calculated based on the output of the flow rate sensor 16.

In FIG. 3, the points indicated by circles represent the pressure loss reduction rate in a case where the pipe diameter d is d1. The points indicated by squares represent the pressure loss reduction rate in a case where the pipe diameter d is d2 (>d1). As illustrated in FIG. 3, the coolant according to the first embodiment maintains the pressure loss at the value of the base 44 under a specific condition and reduces the pressure loss under another condition. In a case where the pipe diameter d is d2, for example, the pressure loss is maintained at the value of the base 44 in a region where 1/τc exceeds α. In a region where α exceeds 1/τc, the pressure loss has a value less than the value of the base 44.

Figure 4:
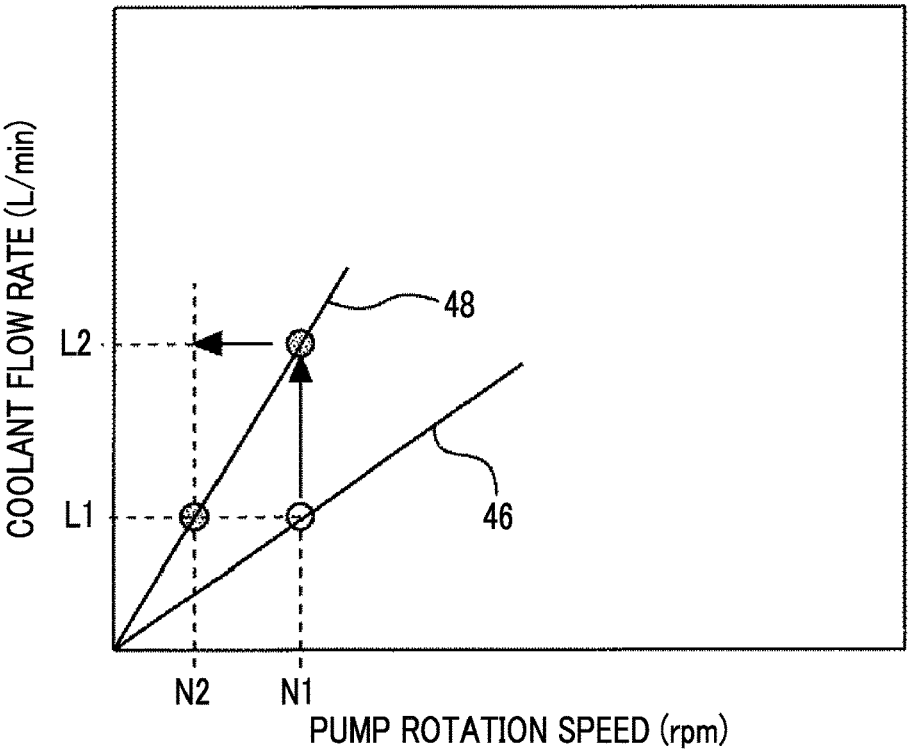
FIG. 4 is a graph for showing a relationship between a pump rotation speed and a coolant flow rate with regard to two types of pressure losses.

FIG. 4 is a graph in which the relationship between the pump rotation speed and the coolant flow rate is shown with regard to two types of pressure losses. More specifically, a characteristic 46 represents a relationship established under the pressure loss of the base 44. A characteristic 48 represents a relationship established under an environment in which the pressure loss is reduced by the Toms effect.

According to the characteristic 46 of the base 44, the coolant flow rate is L1 when the pump rotation speed is N1. Once the coolant expresses the Toms effect in the state described above, the pressure loss of the coolant drops and the coolant flow rate increases to L2. The pump rotation speed can be lowered down to N2 when the coolant flow rate needed for cooling the internal combustion engine 10 is L1 at this time. The power of the coolant pump 26 needed for generating the pump rotation speed of N2 is smaller in amount than the power needed for generating N1. Accordingly, the energy that is needed for driving the coolant pump 26 can be reduced when the Toms effect is expressed by micelle addition to the coolant.

Figure 5:
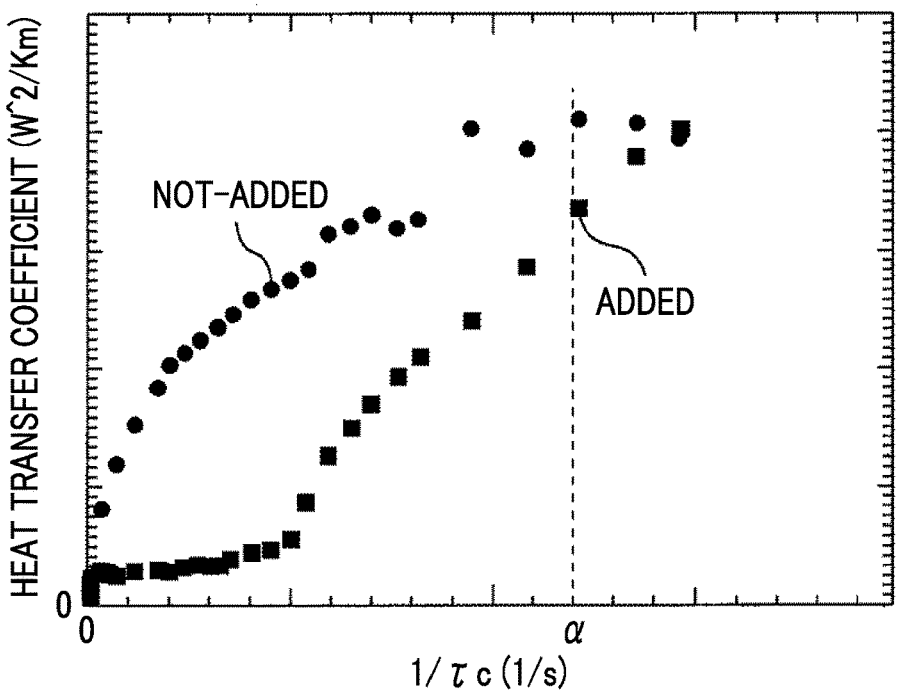
FIG. 5 is a graph for showing a change in a heat transfer coefficient of the coolant resulting from the expression of the Toms effect.

Under the condition in which the Toms effect is expressed, the heat transfer coefficient of the coolant and the pressure loss of the coolant drop at the same time. FIG. 5 shows the relationship between the Toms effect expression index (1/τc) and the heat transfer coefficient of the coolant. The points indicated by black circles in the drawing represent the heat transfer coefficient of a coolant to which no micelle is added. The points indicated by black squares in the drawing represent the heat transfer coefficient of the coolant to which micelles are added at a specific concentration. α in FIG. 5 is a boundary value at which the micelle-containing coolant expresses the Toms effect as described with reference to FIG. 3.

As illustrated in FIG. 5, the micelle-added coolant shows a heat transfer coefficient less than the heat transfer coefficient of the no micelle-added coolant in the region of (1/τc)<α where the Toms effect is expressed. At the same coolant temperature, the amount of heat delivered from the internal combustion engine 10 to the coolant decreases as the heat transfer coefficient of the coolant decreases. Accordingly, when the feedback control to the same target temperature continues to be performed on the temperature of the coolant, the internal combustion engine 10, which was at the moderate temperature before the expression of the Toms effect, is put into a state of being likely to increase in temperature with the expression of the Toms effect. In this regard, in the first embodiment, the setting of the feedback control on the coolant is changed after the expression of the Toms effect such that the effect of a decline in heat transfer coefficient on the heat receiving amount is offset.

Determination on Micelle Addition

The Toms effect is expressed in a case where micelles are added to the coolant and τC satisfies a specific condition.

Figure 6:
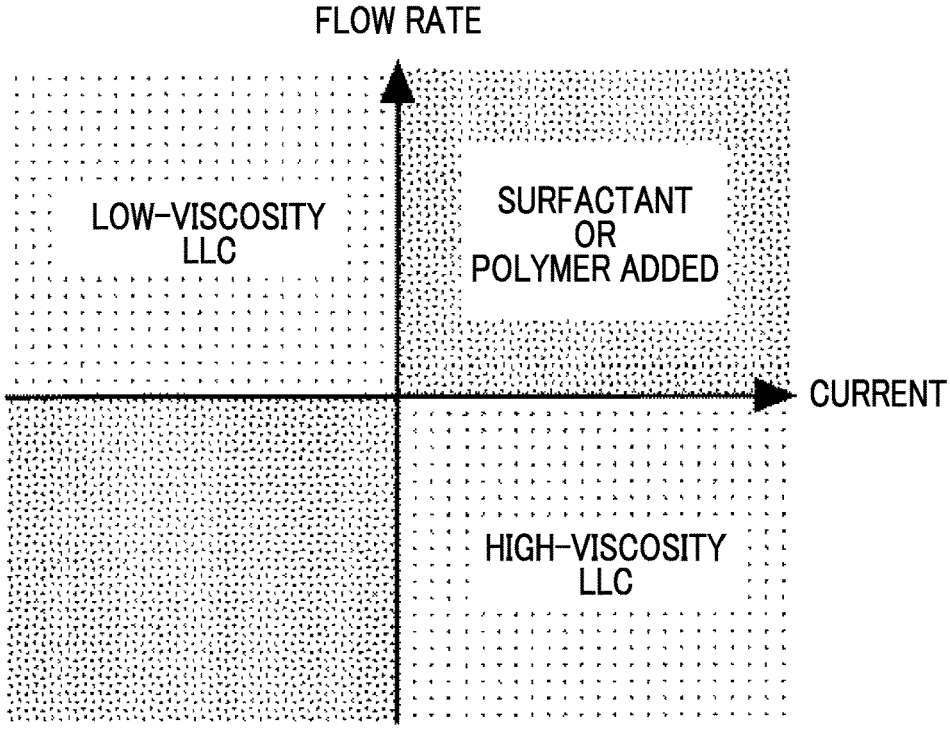
FIG. 6 is a diagram for showing a method for determining characteristics of the coolant based on a current flowing through a coolant pump and the flow rate of the coolant.

FIG. 6 is a diagram for showing a method for determining the characteristics of the coolant based on the current flowing through the coolant pump 26 and the flow rate of the coolant. In the first embodiment, whether or not micelles are added to the coolant is determined based on the relationship that is illustrated in FIG. 6.

The horizontal axis of FIG. 6 represents the current flowing through the coolant pump 26. In the first embodiment, the coolant pump 26 is driven by a direct current motor, and thus the current represented by the horizontal axis can be treated as a substitute value of the pump work.

The vertical axis of FIG. 6 is the flow rate of the coolant flowing through the circulation path 18. The starting point in FIG. 6, that is, the intersection point of the vertical axis and the horizontal axis corresponds to reference values of the flow rate and the current. The reference values of the flow rate and the current mean the flow rate and the current resulting from the feedback control in a case where no micelle is added and a coolant that has a standard viscosity is used.

The second quadrant of FIG. 6 corresponds to a situation in which the pump work (current) is less than the reference value and a flow rate exceeding the reference value is generated. This situation occurs in a case where the coolant shows a standard pressure loss and the viscosity of the coolant is lower than a standard. In this case, it can be estimated that the coolant that is used is a no micelle-containing low-viscosity long life coolant (LLC).

The third quadrant of FIG. 6 corresponds to a situation in which both the pump work and the coolant flow rate fall within the reference values. This situation occurs in a case where the coolant shows a standard pressure loss and has a standard viscosity. Accordingly, in a case where the flow rate and the current belong to the third quadrant, a determination can be made that a no micelle-containing standard coolant is used. Alternatively, coolant leakage from the coolant pump 26 or a cooling system is conceivable.

The fourth quadrant of FIG. 6 corresponds to a situation in which the pump work exceeds the reference value and a flow rate less than the reference value is generated. This situation occurs in a case where the coolant shows a standard pressure loss and the viscosity of the coolant is higher than a standard. Accordingly, in this case, a determination can be made that the coolant that is used is a no micelle-containing high-viscosity LLC.

The first quadrant of FIG. 6 corresponds to a situation in which the coolant pump 26 is operated at pump work exceeding the reference value and a flow rate exceeding the reference value is generated. This situation occurs solely in a case where the coolant that is used contains micelles. Accordingly, in a case where the condition of the first quadrant is established, a determination can be made that the coolant that is used contains micelles. In the first embodiment, the ECU 42 performs micelle determination by this method.

Control According to First Embodiment

Figure 7:
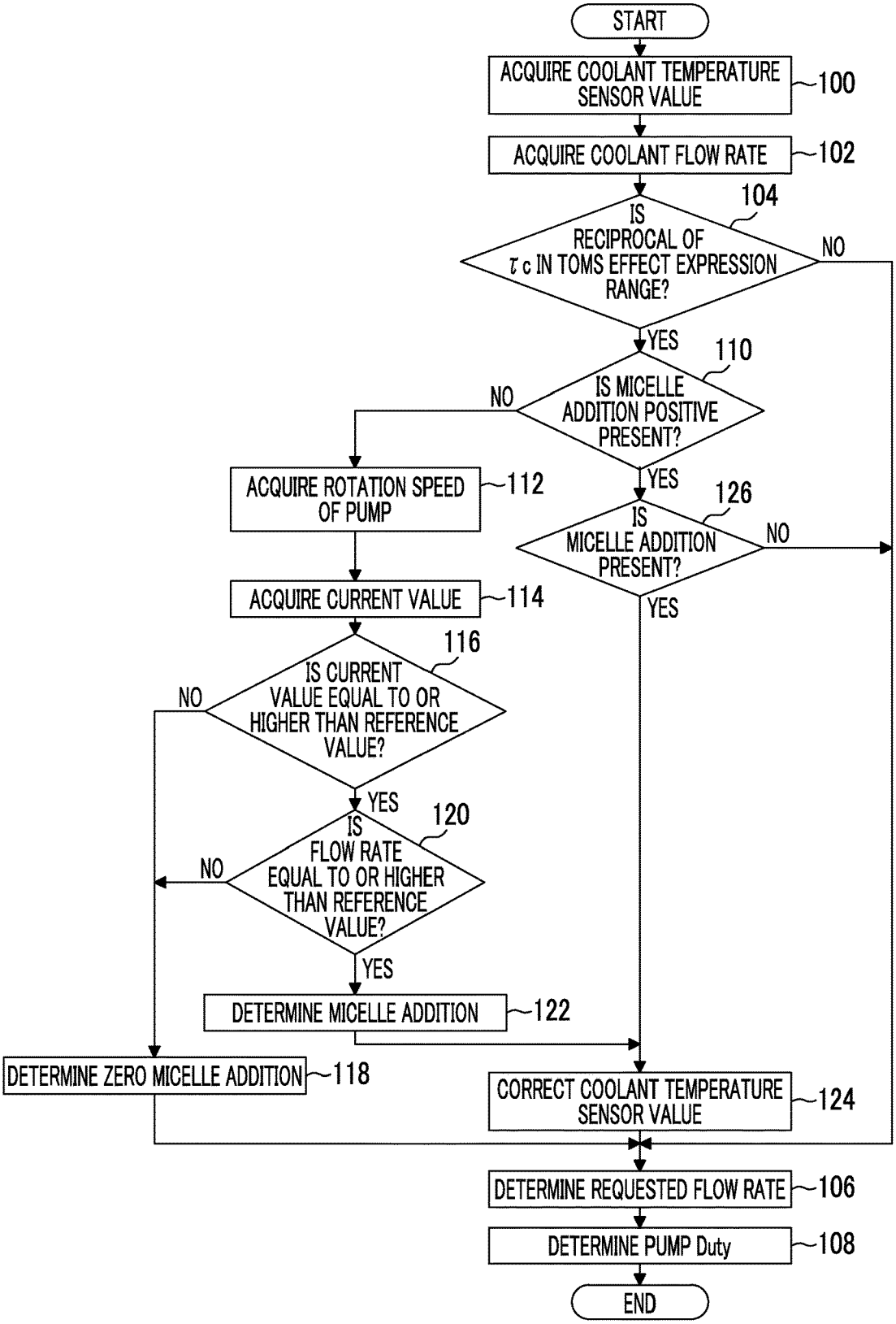
FIG. 7 is a flowchart of a routine executed by an ECU in the first embodiment.

FIG. 7 is a flowchart of a routine executed by the ECU 42 according to the first embodiment. The routine illustrated in FIG. 7 is repeatedly executed at a predetermined processing cycle after the internal combustion engine 10 is started. Once the routine illustrated in FIG. 7 is started, the output of the coolant temperature sensor 12 is acquired first by the ECU 42 (Step 100).

The ECU 42 acquires the flow rate of the coolant based on the output of the flow rate sensor 16 (Step 102).

The ECU 42 determines whether or not ($1/\tau c$) belongs to a Toms effect expression range (Step 104). An arithmetic expression established between the flow rate and $\tau c$ in the configuration of the first embodiment is stored in the ECU 42. In this step, $\tau c$ is calculated first in accordance with the arithmetic expression. The ECU 42 also stores the range of ($1/\tau c$) in which the Toms effect is expressed in the configuration of the first embodiment. Subsequently, the ECU 42 determines whether the calculated value of $\tau c$ satisfies the range.

In a case where the ECU 42 determines as a result of the determination that ($1/\tau c$) does not belong to the range, the ECU 42 is capable of determining that there is no room for Toms effect expression by the coolant. In this case, processing for determining a requested flow rate is performed without a change in the setting of the feedback control (Step 106). According to the processing process of Step 106, a coolant flow rate for allowing the output of the coolant temperature sensor 12 to match the target temperature is determined in this step.

Once the processing of Step 106 is over, the ECU 42 determines a pump duty for generating the requested flow rate (Step 108). Then, the coolant pump 26 is driven at the pump duty. Under a situation in which the Toms effect is not expressed, the internal combustion engine 10 is cooled to the moderate temperature by the coolant flow rate being controlled by the processing of Step 108.

In a case where the ECU 42 determines in Step 104 that ($1/\tau c$) belongs to the Toms effect expression range, the ECU 42 determines whether or not the micelle determination is already executed (Step 110).

In a case where the ECU 42 determines as a result that the micelle determination is not yet to be executed, the ECU 42 executes processing for determining whether or not micelles are contained in the coolant. In this step, the rotation speed of the coolant pump 26 is acquired first (Step 112). Then, the current flowing through the coolant pump 26 is acquired (Step 114).

As described with reference to FIG. 6, the current and the flow rate fit in the respective reference values when the coolant that is used is a standard coolant containing no micelle. Each of the reference values of the current and the flow rate varies with the pump rotation speed and the coolant temperature. Once the processing of Step 114 is over, the ECU 42 determines first whether or not the current is equal to or higher than the reference value of the current (Step 116).

Figure 8:
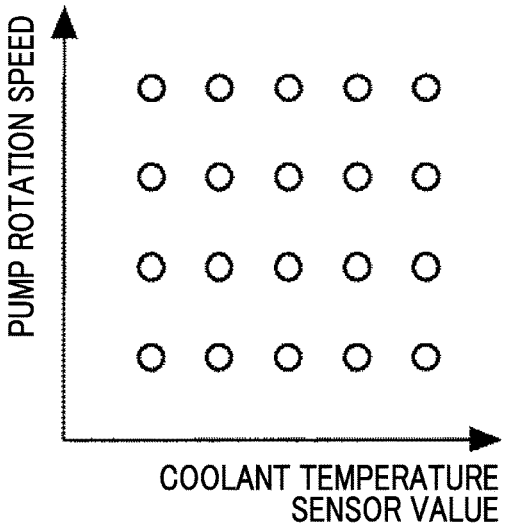
FIG. 8 is a graph illustrating an overview of a map referred to for calculation of a reference value of the current flowing through the coolant pump during the routine illustrated in FIG. 7.

FIG. 8 shows an overview of a map that the ECU 42 refers to in Step 116. The map illustrated in FIG. 8 is a two-dimensional map that has the output of the coolant temperature sensor 12 and the pump rotation speed as its axes. The reference value of the current that is experimentally acquired is determined in the map. In Step 116, the ECU 42 reads the reference value of the current from the map based on the coolant temperature acquired in Step 100 and the pump rotation speed acquired in Step 112. Then, the ECU 42 determines whether the current acquired in Step 114 is equal to or higher than the reference value of the current.

When micelles are added to the coolant, a current equal to or higher than the reference value flows through the coolant pump 26. Accordingly, in the case of a negative determination in Step 116, the ECU 42 is capable of determining that no micelle is contained in the coolant. In this case, a zero micelle addition determination is performed and micelle determination execution completion flag processing is performed (Step 118). Subsequently, the feedback control on the coolant flow rate is performed by normal setting by the processing of Steps 106 and 108.

In a case where the ECU 42 determines in Step 116 that the current of the coolant pump 26 is equal to or higher than the reference value, the ECU 42 additionally determines whether the flow rate of the coolant is equal to or higher than the reference value of the flow rate (Step 120).

The ECU 42 stores a two-dimensional map similar to the map illustrated in FIG. 8 with regard to the reference value of the flow rate as well. In Step 120, the ECU 42 reads the reference value of the flow rate from the map based on the coolant temperature and the pump rotation speed acquired during the current processing cycle. Then, the ECU 42 determines whether the flow rate acquired in Step 102 is equal to or higher than the reference value of the flow rate.

The ECU 42 is capable of determining that no micelle is contained in the coolant in a case where the ECU 42 determines as a result of the determination that the current coolant flow rate is not less than the reference value of the flow rate. In this case, the ECU 42 executes the processing following Step 118 described above subsequently.

The ECU 42 is capable of determining that micelles are added to the coolant in a case where the ECU 42 determines in Step 120 that the flow rate of the coolant is equal to or higher than the reference value. In this case, a micelle addition determination is performed and the micelle determination execution completion flag processing is executed (Step 122).

The processing of Step 122 is executed in a case where micelles are added to the coolant and $(1/\tau c)$ satisfies the Toms effect expression condition. Accordingly, the ECU 42 is capable of determining that the coolant expresses the Toms effect in a case where the processing of Step 122 is executed. More specifically, the ECU 42 is capable of determining that the coolant has a reduced pressure loss and the heat transfer coefficient of the coolant is reduced. In this case, a correction for compensating for a decrease in heat receiving amount resulting from a decline in heat transfer coefficient is applied to the output of the coolant temperature sensor 12 (Step 124).

Figure 9:
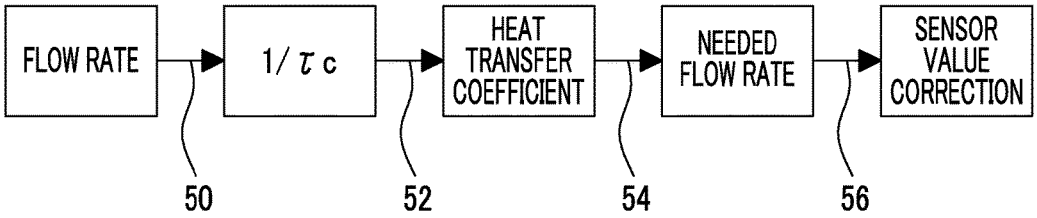
FIG. 9 is a diagram for showing a correlation between the flow rate of the coolant and an output correction value of a coolant temperature sensor.

FIG. 9 is a diagram for showing the correlation between the flow rate of the coolant and an output correction value of the coolant temperature sensor. As described above, the index $\tau c$ can be calculated when the flow rate of the coolant is determined (refer to an arrow 50). When $\tau c$ is determined, the heat transfer coefficient in the case of zero micelle addition and the heat transfer coefficient under the expression of the Toms effect can be identified from the relationship illustrated in FIG. 5 (refer to an arrow 52). When the heat transfer coefficients are determined, a flow rate needed for obtaining a heat receiving amount similar to the case of zero micelle addition under the expression of the Toms effect can be identified (refer to an arrow 54). When the needed flow rate of the coolant is determined, a correction value that should be applied to the output of the coolant temperature sensor 12 for obtaining the needed flow rate can be identified (refer to an arrow 56). In other words, in the system according to the first embodiment, the correction value that should be applied to the output of the coolant temperature sensor 12 under the expression of the Toms effect can be identified based on the flow rate of the coolant.

The ECU 42 stores rules needed for the identification as a map. In Step 124, the ECU 42 calculates the output correction value of the coolant temperature sensor 12 by applying the flow rate acquired in Step 102 to the map. The output correction value is a value larger than a pre-correction output.

Once the processing of Step 124 is over, the ECU 42 executes the processing of Steps 106 and 108 by using the output correction value. In this step, feedback control for allowing the output correction value corrected to a high temperature side to approach the target temperature is executed. When the output correction value exceeds the target temperature, for example, the flow rate of the coolant is increased for a decline in output correction value. As a result, the effect of the heat transfer coefficient lowered due to the effect of the Toms effect is compensated for and the internal combustion engine 10 is maintained at an appropriate temperature.

In a case where this routine is started again after the execution of Step 118 or Step 122, the ECU 42 determines that the micelle determination is already executed in Step 110. In this case, the ECU 42 determines whether the determination is a "micelle addition presence" determination (Step 126).

In a case where the determination is not the "micelle addition presence" as a result, the ECU 42 is capable of determining that there is no room for Toms effect expression by the coolant. In this case, the processing of Step 124 is jumped, and then Steps 106 and 108 are executed under normal feedback setting. In a case where the determination is the "micelle addition presence", the ECU 42 executes the processing following Step 124.

According to the processing described above, under an environment in which the coolant does not express the Toms effect, the feedback control on the flow rate of the coolant is performed under normal setting regardless of whether or not micelles are added. As a result, the temperature of the internal combustion engine 10 is controlled to the moderate temperature. In a case where micelles are added to the coolant and the Toms effect expression condition is satisfied, the feedback control on the coolant temperature is performed based on the sensor output corrected to the high temperature side. As a result, a heat receiving amount decrement is supplemented and the temperature of the internal combustion engine 10 is controlled to the moderate temperature as well.

Modification Example of First Embodiment

In the first embodiment described above, the effect resulting from a decline in the heat transfer coefficient of the coolant is compensated for by the output of the coolant temperature sensor 12 being corrected. However, methods for the compensation are not limited thereto. The target temperature of the feedback control may also be corrected to a low temperature side for needed compensation to be obtained instead of the method or along with the method.

The pump work may also be accurately calculated based on the voltage provided for the coolant pump 26 and the current flowing through the coolant pump 26.

Second Embodiment

Configuration of Second Embodiment

Figure 10:
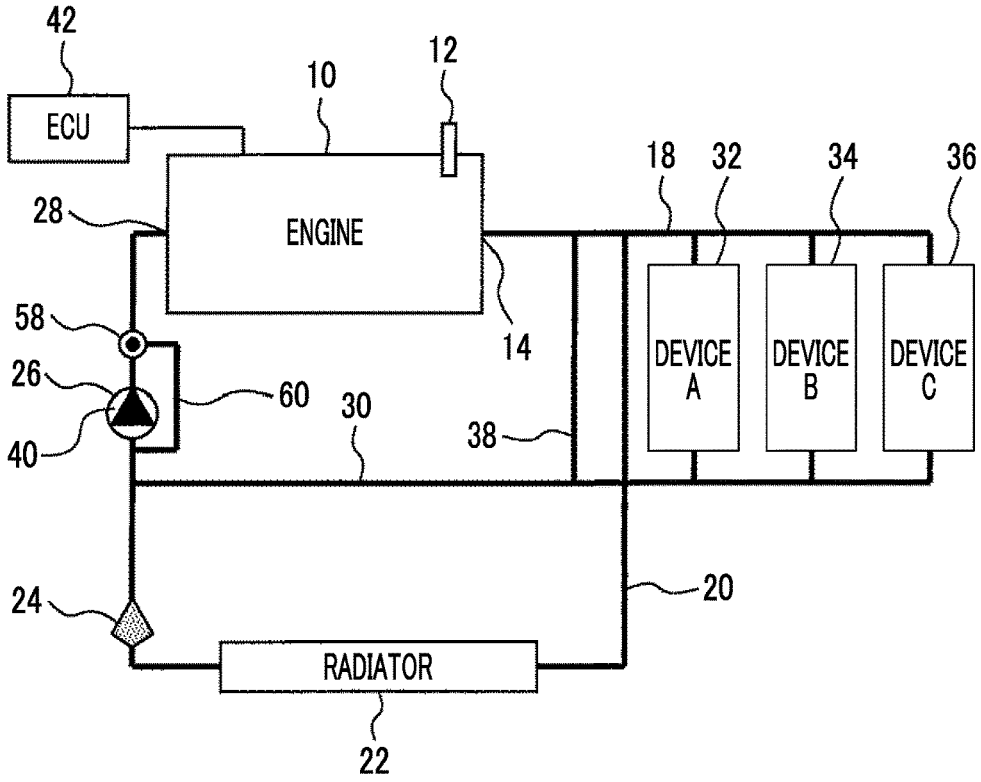
FIG. 10 is a diagram illustrating a configuration of a cooling device according to a second embodiment.

A second embodiment will be described with reference to FIGS. 10 to 13. FIG. 10 is a diagram for showing a configuration of a cooling device according to the second embodiment. The configuration of the cooling device according to the second embodiment is identical to the case of the first embodiment except that a differential pressure sensor 58 is provided instead of the flow rate sensor 16. The cooling device according to the second embodiment can be realized by the ECU 42 executing a routine illustrated in FIG. 13 (described later) in the system that is illustrated in FIG. 10. In the following description of the second embodiment, the same reference numerals as in the case of the first embodiment will be used to refer to the same or corresponding elements and description thereof will be omitted or simplified.

The cooling device illustrated in FIG. 10 is provided with the differential pressure sensor 58 downstream of the coolant pump 26. A passage 60 leading to the upstream of the coolant pump 26 communicates with the differential pressure sensor 58. The differential pressure sensor 58 is capable of detecting the differential pressure that is generated ahead of and behind the coolant pump 26.

Figure 11:
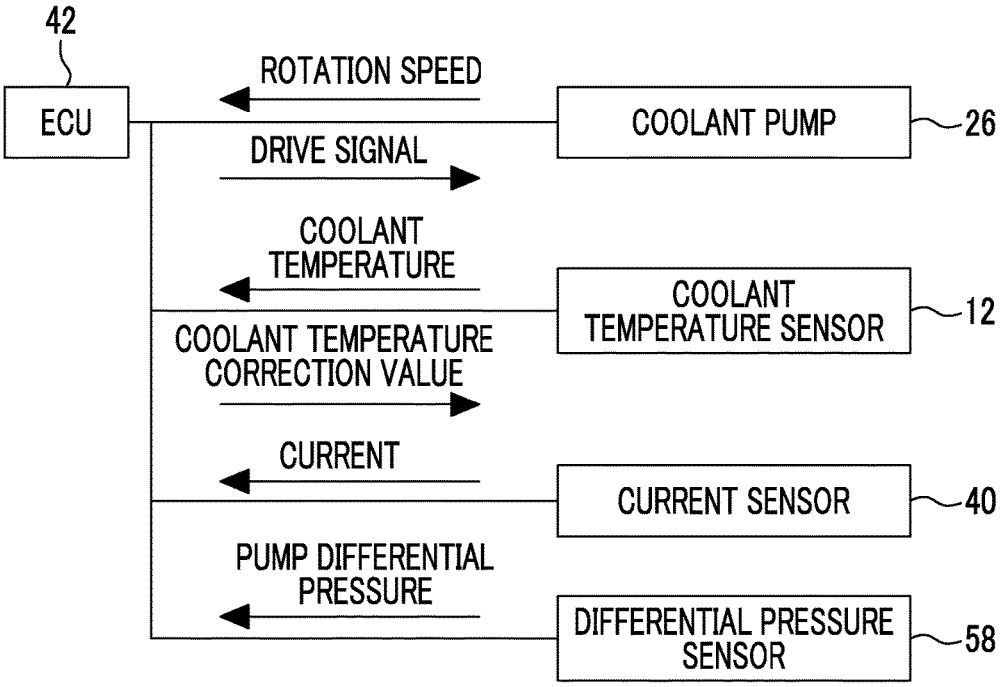
FIG. 11 is a diagram illustrating a configuration of a control system of the cooling device according to the second embodiment.

FIG. 11 shows a configuration of a control system of the cooling device according to the second embodiment. In the second embodiment, the differential pressure sensor 58 as well as the coolant pump 26, the coolant temperature sensor 12, and the current sensor 40 is connected to the ECU 42. The cooling device according to the second embodiment is characterized by the ECU 42 calculating the flow rate of the coolant based on the output of the differential pressure sensor 58.

Coolant Flow Rate Calculation Method

Figure 12:
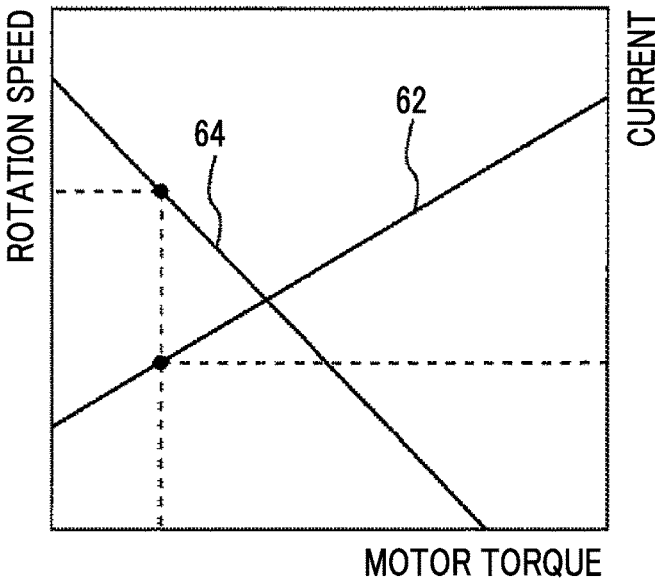
FIG. 12 is a graph for showing a principle of coolant pump rotation speed calculation from the current flowing through the coolant pump.

FIG. 12 is a graph for showing a principle of the calculation of the rotation speed of the coolant pump 26 from the current flowing through the coolant pump 26. More specifically, the straight line with sign 62 in FIG. 12 represents a T-I characteristic line established between the current and the motor torque of the coolant pump 26. The straight line with sign 64 represents a T-NE characteristic line established between the rotation speed and the motor torque of the coolant pump 26.

In the system according to the second embodiment, the current flowing through the coolant pump 26 can be detected by the current sensor 40. The T-I characteristic line 62 is known, and thus the motor torque can be identified when the current is determined. The T-NE characteristic line 64 is known as well, and thus the pump rotation speed can also be identified when the motor torque is determined. Accordingly, in the second embodiment, the ECU 42 is capable of calculating the pump rotation speed from the current flowing through the coolant pump 26.

In the coolant pump 26, the motor output is consumed by the sliding friction of a rotor shaft and the pump work. The relationship among the motor output, the pump work, and the sliding friction of the rotor shaft can be expressed by the following Equation (2).

$$\text{Motor output} = \text{Pump work} + \text{Sliding friction of rotor shaft} \quad (2)$$

The "motor output" in Equation (2) above is determined by the rotation speed and the torque of the motor. Accordingly, the ECU 42 is capable of calculating the "motor output" based on the output of the current sensor 40 from the characteristics illustrated in FIG. 12.

The "sliding friction of rotor shaft" in Equation (2) above is a function of the rotation speed of the rotor shaft, that is, the pump rotation speed. The pump rotation speed can be calculated based on the current as described above. Accordingly, the ECU 42 is also capable of calculating the "sliding friction of rotor shaft" based on the output of the current sensor 40. The "pump work" can be calculated when the "motor output" and the "sliding friction of rotor shaft" are substituted into Equation (2) above.

With regard to the "pump work", the following relationship is established between the flow rate of the coolant and the differential pressure ahead of and behind the pump.

$$\text{Pump work} = \text{Flow rate} * \text{Differential pressure} \quad (3)$$

In the second embodiment, the "differential pressure" in Equation (3) above can be detected by the differential pressure sensor 58. Accordingly, the ECU 42 is capable of calculating the "flow rate" by substituting the "differential pressure" and the "pump work" acquired by calculation into Equation (3). As described above, according to the configuration of the second embodiment, the flow rate of the coolant can be obtained by calculation by the use of the output of the differential pressure sensor 58 and without the use of the flow rate sensor 16.

Control According to Second Embodiment

Figure 13:
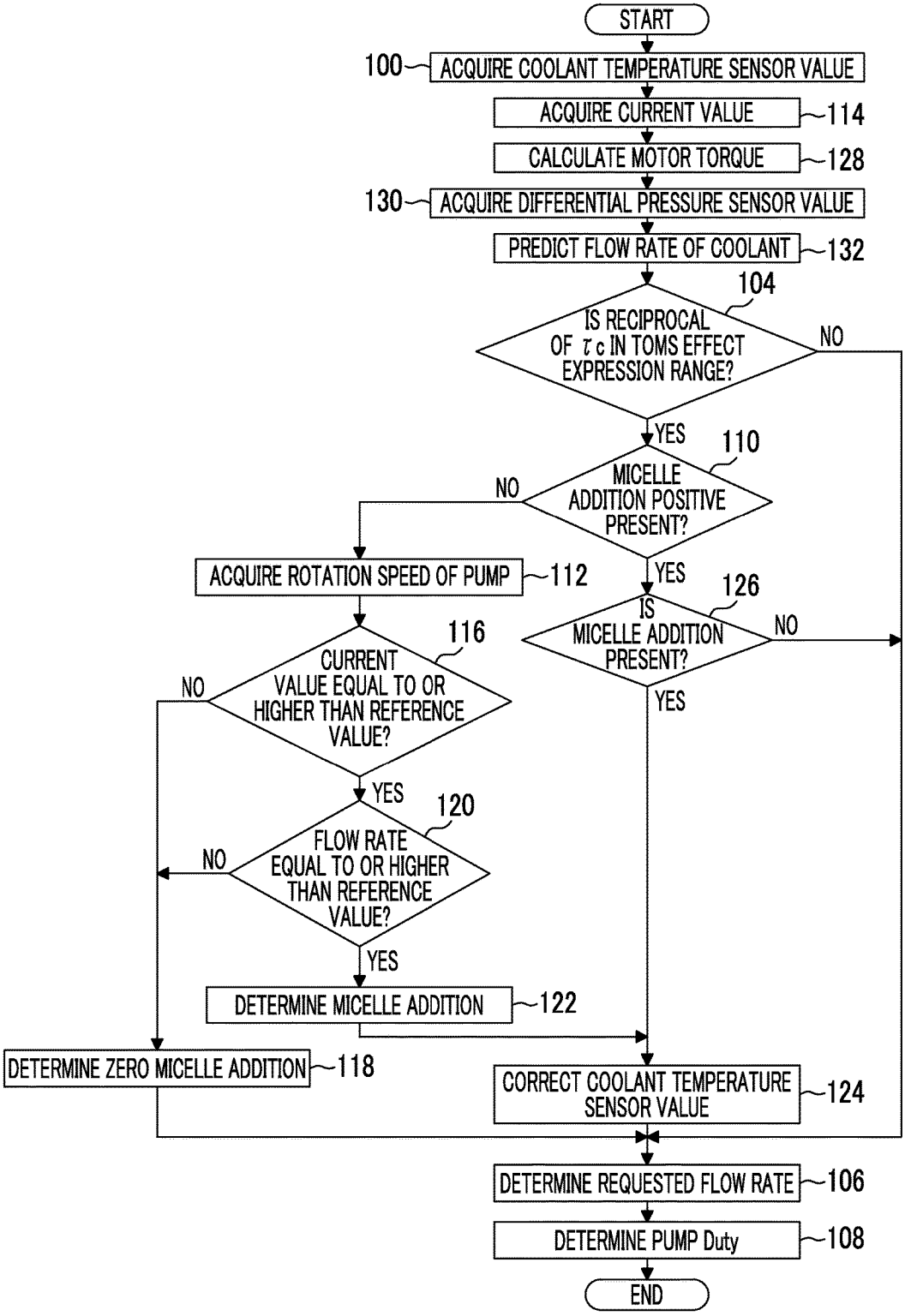
FIG. 13 is a flowchart of a routine executed by an ECU in the second embodiment.

FIG. 13 is a flowchart of a routine that is executed by the ECU 42 in the second embodiment. The routine that is illustrated in FIG. 13 is identical to the routine illustrated in FIG. 7 except that Step 114 is executed immediately after Step 100 and Steps 128 to 132 are executed after Step 114. In the following description of the steps illustrated in FIG. 13, the same signs as in the steps illustrated in FIG. 7 will be used to refer to the same or corresponding steps and description thereof will be omitted or simplified.

In the routine illustrated in FIG. 13, the output of the current sensor 40 is acquired (Step 114) after the processing of Step 100. The ECU 42 detects the current flowing through the coolant pump 26 by the processing of Step 114.

The ECU 42 calculates the motor torque of the coolant pump 26 (Step 128). The ECU 42 stores the relationship of the T-I characteristic line 62 described with reference to FIG. 12. In this step, the ECU 42 calculates the motor torque by applying the current acquired in Step 114 to the relationship.

The ECU 42 acquires the output of the differential pressure sensor 58 (Step 130). The ECU 42 detects the differential pressure ahead of and behind the coolant pump 26 based on the output.

The ECU 42 calculates the flow rate of the coolant by the method described with reference to FIG. 12 (Step 132). Specifically, the ECU 42 stores the relationship of the T-NE characteristic line 64 illustrated in FIG. 12. In Step 132, the ECU 42 calculates the pump rotation speed first by applying the motor torque calculated in Step 128 to the relationship. In addition, the ECU 42 stores a map for obtaining the sliding friction of the rotor shaft from the pump rotation speed. In Step 132, the ECU 42 subsequently calculates the sliding friction of the rotor shaft in accordance with the map. Furthermore, the ECU 42 stores the relationship of Equations (2) and (3) above. Then, the ECU 42 calculates the pump work by substituting the sliding friction of the rotor shaft and the motor output ($2 * \pi *$motor torque*motor rotation speed) into Equation (2) above. Lastly, the ECU 42 obtains the flow rate of the coolant by dividing the pump work by the differential pressure acquired in Step 130.

The processing following Step 104 in the routine illustrated in FIG. 13 can be executed as in the case of the first embodiment when the flow rate and current are determined. Accordingly, even by the cooling device according to the second embodiment, the temperature of the internal combustion engine 10 can be maintained at the moderate temperature even when the micelle-containing coolant expresses the Toms effect as in the case of the first embodiment.

Modification Example of Second Embodiment

In the second embodiment described above, the pump rotation speed is obtained from the current in accordance with the relationship illustrated in FIG. 12. However, methods for obtaining the pump rotation speed are not limited thereto. In other words, the pump rotation speed may also be detected by a sensor incorporated into the coolant pump 26 as in the case of the first embodiment. In contrast, the pump rotation speed in the first embodiment may also be obtained from the current in accordance with the relationship illustrated in FIG. 12 as in the case of the second embodiment.

Third Embodiment

Figure 14:
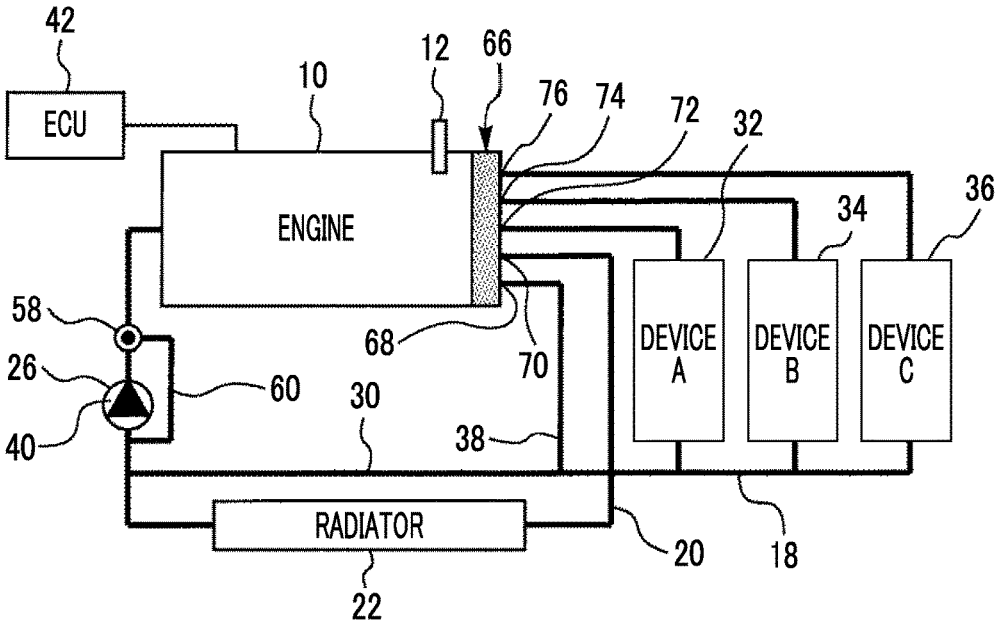
FIG. 14 is a diagram illustrating a configuration of a cooling device according to a third embodiment.

A third embodiment will be described with reference to FIGS. 14 to 16. FIG. 14 is a diagram for showing a configuration of a cooling device according to the third embodiment. The configuration of the third embodiment is identical to the case of the second embodiment except that the circulation path 18 is provided with a valve 66. The cooling device according to the third embodiment can be realized by the ECU 42 executing a routine illustrated in FIG. 16 (described later) in the system that is illustrated in FIG. 14. In the following description of the embodiment, the same reference numerals as in the case of the second embodiment will be used to refer to the same or corresponding elements and description thereof will be omitted or simplified.

The cooling device illustrated in FIG. 14 is provided with the valve 66 between the water jacket of the internal combustion engine 10 and the circulation path 18. The valve 66 has an inflow port leading to the water jacket and a plurality of outflow ports 68, 70, 72, 74, 76. The bypass passage 38, the radiator path 20, the heat exchange device 32 for a heater, the transmission oil warmer 34, and the oil cooler 36 communicate with the outflow ports 68, 70, 72, 74, 76, respectively. The valve 66 is capable of changing the ratio of the coolant flowing out from each of the outflow ports in accordance with a command supplied from the outside.

Figure 15:
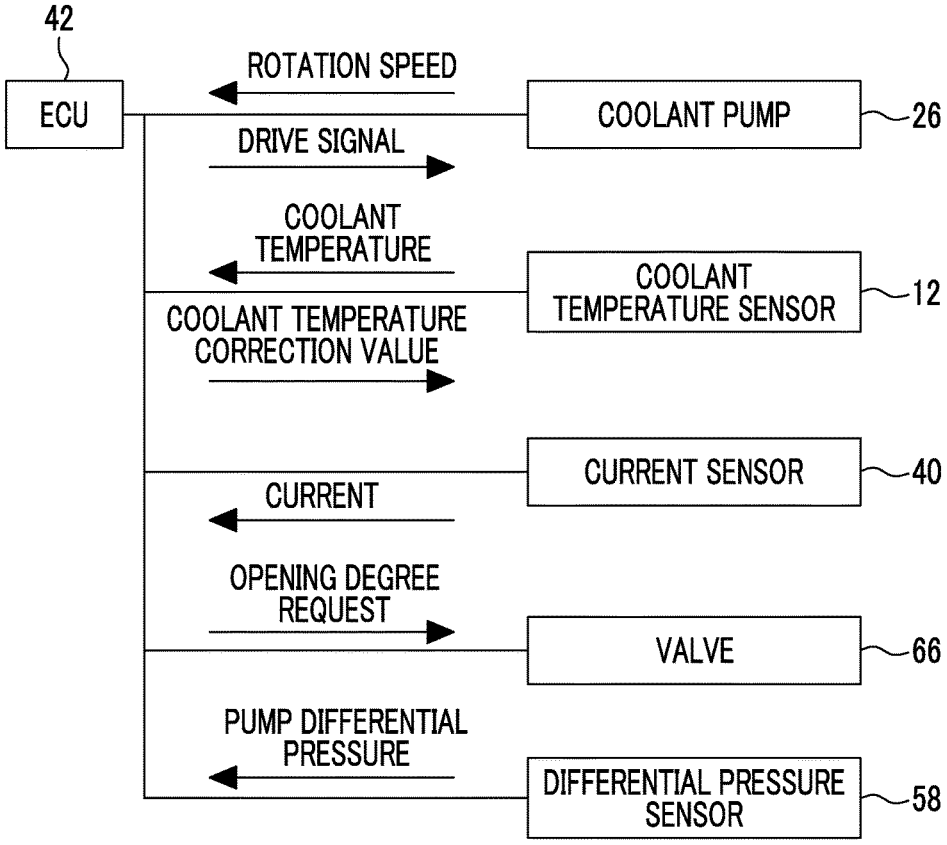
FIG. 15 is a diagram illustrating a configuration of a control system of the cooling device according to the third embodiment.

FIG. 15 shows a configuration of a control system of the cooling device according to the third embodiment. In the third embodiment, the valve 66 as well as the coolant pump 26 is connected to the ECU 42. The ECU 42 is capable of supplying a command with respect to the valve 66 with regard to the ratios of opening of the outflow ports 68, 70, 72, 74, 76.

Purpose of Valve Control

The heat exchange device 32 for a heater of the system illustrated in FIG. 14 is a heat exchanger for providing hot air into the vehicle cabin of a vehicle in which the internal combustion engine 10 is mounted. A micelle-added coolant is likely to express the Toms effect at a low temperature. Under the expression of the Toms effect, the heat transfer coefficient of the coolant drops, and thus the heat exchange amount of the heat exchange device 32 for a heater is also small. In contrast, at a low temperature at which the Toms effect is likely to be expressed, an occupant in the vehicle is highly likely to request a heater. Accordingly, in the third embodiment, the coolant flowing through the circulation path 18 is preferentially distributed to the heat exchange device 32 for a heater in a case where the heater request is present so that a sufficient heating capacity is ensured even under the expression of the Toms effect.

Control According to Third Embodiment

Figure 16:
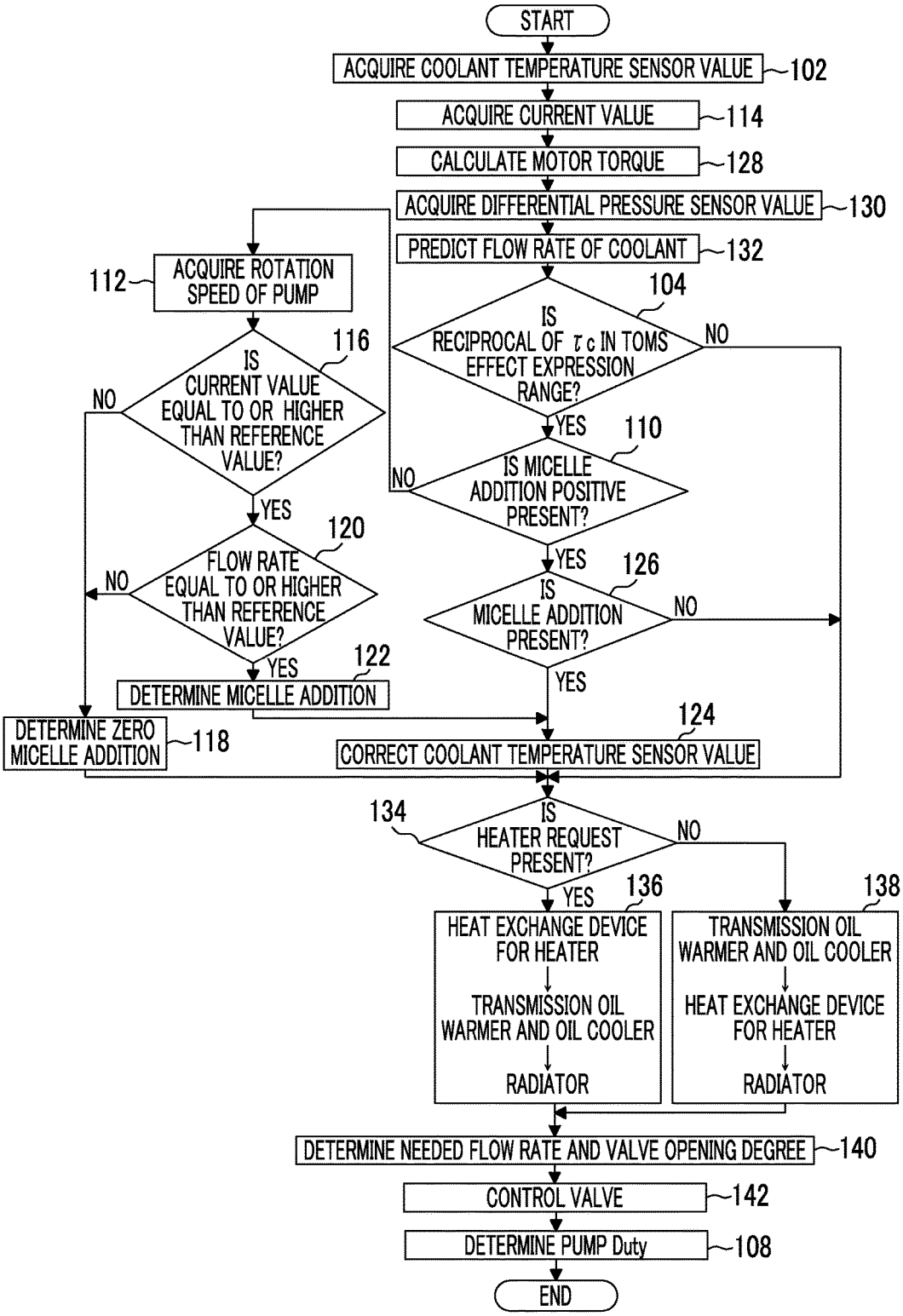
FIG. 16 is a flowchart of a routine executed by an ECU in the third embodiment.

FIG. 16 is a flowchart of a routine executed by the ECU 42 in the third embodiment. The routine illustrated in FIG. 16 is identical to the routine illustrated in FIG. 13 except that Step 106 is replaced with Steps 134 to 142. In the following description of the steps illustrated in FIG. 16, the same signs as in the steps illustrated in FIG. 13 will be used to refer to the same or corresponding steps and description thereof will be omitted or simplified.

In the routine illustrated in FIG. 16, the ECU 42 determines whether or not the heater request is present (Step 134) after, for example, the ECU 42 makes the zero micelle addition determination in Step 118 or after the output of the coolant temperature sensor 12 is corrected in Step 124. In the third embodiment, a heater switch or the like emitting a signal in accordance with the presence or absence of the heater request is connected to the ECU 42. In this step, the ECU 42 determines the presence or absence of the heater request based on the signal.

In a case where the ECU 42 determines that the heater request is present by the processing of Step 134, the ECU 42 determines the priority relating to the coolant distribution as follows (Step 136).

1. Heat exchange device 32 for heater
2. Transmission oil warmer 34 and oil cooler 36
3. Radiator 22

In a case where the ECU 42 determines in Step 134 that the heater request is absent, in contrast, the ECU 42 determines the priority as follows (Step 138).

1. Transmission oil warmer 34 and oil cooler 36
2. Heat exchange device 32 for heater
3. Radiator 22

The ECU 42 determines a needed coolant flow rate and the valve opening degree of the valve 66 (Step 140). The needed coolant flow rate is calculated based on the output of the coolant temperature sensor 12 or the correction value of the output as in the case of the first and second embodiments. The valve opening degree is determined in accordance with the priority determined in Step 136 or Step 138.

The ECU 42 issues a command for realizing a desired valve opening degree with respect to the valve 66 (Step 142). As a result, the following state is realized in a case where, for example, the priority of Step 136 is selected.

1. The opening degree of the valve leading to the heat exchange device 32 for a heater becomes 100%.
2. Each of the opening degrees of the valves leading to the transmission oil warmer 34 and the oil cooler 36 becomes $\alpha a\%$ less than 100%.
3. The opening degree of the valve leading to the radiator 22 becomes $\beta a\%$ less than $\alpha a\%$.

According to the setting described above, the coolant can be circulated with a capacity of 100% through the heat exchange device 32 for a heater. Therefore, according to the third embodiment, an excellent heating capacity can be ensured when the heater request occurs even under a situation in which the heat transfer coefficient of the coolant drops due to the expression of the Toms effect.

In contrast, the following state is realized in a case where the priority of Step 138 is selected in relation to the coolant distribution.

1. The opening degrees of the valves leading to the transmission oil warmer 34 and the oil cooler 36 become 100% alike.
2. The opening degree of the valve leading to the heat exchange device 32 for a heater becomes $\alpha b\%$ less than 100%.
3. The opening degree of the valve leading to the radiator 22 becomes $\beta b\%$ less than $\alpha b\%$.

In a case where the heater request is absent, amount of heat does not need to be given to the heat exchange device 32 for a heater. In contrast, the transmission oil warmer 34 is capable of giving amount of heat to the transmission oil as the coolant distribution amount increases. The cooling capacity of the oil cooler 36 increases as the coolant distribution amount increases. According to the priority described above, the heating capacity and the cooling capacity of cooling can be effectively used without being wasted in a case where the heater request is absent.

As described above, with the cooling device of the third embodiment, concentrated coolant circulation can be performed in a place where the coolant is needed. Accordingly, with the device described above, heat exchange needed in each place in the vehicle can be continuously performed in an appropriate manner even under a situation in which the heat transfer effect of the coolant drops due to the Toms effect.

Modification Example of Third Embodiment

In the third embodiment described above, a mechanism changing the priority relating to the coolant distribution in accordance with the presence or absence of the heater request is incorporated into the configuration of the second embodiment. However, objects incorporating the mechanism are not limited to the configuration of the second embodiment. The mechanism may also be incorporated into the configuration of the first embodiment.

In the third embodiment described above, the transmission oil warmer 34 and the oil cooler 36 are exemplified as devices incorporated into the circulation path 18 along with the heat exchange device 32 for a heater. Another heat exchange device may also be incorporated into the circulation path 18 in place of the devices or in combination with the devices.

What is claimed is:

1. A cooling device for an internal combustion engine, the cooling device comprising:

a circulation path for a coolant, the circulation path including a water jacket of the internal combustion engine;

a coolant temperature sensor disposed on the circulation path, the coolant temperature sensor being configured to detect a coolant temperature;

a coolant pump disposed on the circulation path; and an electronic control unit configured to control the coolant pump based on an output of the coolant temperature sensor, wherein the electronic control unit is configured to execute processing for performing feedback control on power of the coolant pump such that the output of the coolant temperature sensor becomes a target temperature, micelle determination processing for determining whether or not micelles are added to the coolant based on pump work of the coolant pump and a flow rate of the coolant flowing through the circulation path, Toms determination processing for determining whether or not the flow rate satisfies a Toms effect expression condition, and correction processing for increasing a relative value of the output of the coolant temperature sensor with respect to the target temperature when the micelles is added and the Toms effect expression condition is established.

2. The cooling device according to claim 1, wherein the correction processing includes processing for correcting the output of the coolant temperature sensor to a high temperature side based on the flow rate of the coolant.

3. The cooling device according to claim 1, wherein the correction processing includes processing for correcting the target temperature to a low temperature side based on the flow rate of the coolant.

4. The cooling device according to claim 1, further comprising:

a power source configured to supply a voltage to the coolant pump;

a current sensor configured to detect a current flowing through the coolant pump; and a flow rate sensor disposed on the circulation path, wherein the electronic control unit is configured to calculate the pump work based on an output of the current sensor and calculate the flow rate of the coolant based on an output of the flow rate sensor.

5. The cooling device according to claim 1, further comprising:

a power source configured to supply a voltage to the coolant pump;

a current sensor configured to detect a current flowing through the coolant pump; and a differential pressure sensor configured to detect a differential pressure ahead of and behind the coolant pump, wherein the electronic control unit is configured to calculate the pump work based on the output of the current sensor and calculate the flow rate of the coolant based on the pump work and an output of the differential pressure sensor.

6. The cooling device according to claim 1, wherein:

the micelle determination processing includes processing for detecting a rotation speed of the coolant pump, processing for calculating a reference value of the pump work based on the rotation speed of the coolant pump and the output of the coolant temperature sensor, and processing for calculating a reference value of the flow rate based on the rotation speed of the coolant pump and the output of the coolant temperature sensor; and the electronic control unit is configured to determine that the micelles are added to the coolant when the pump work is equal to or higher than the reference value of the pump work and the flow rate of the coolant is equal to or higher than the reference value of the flow rate of the coolant.

7. The cooling device according to claim 1, further comprising:

a first heat exchange device for a heater, the first heat exchange device being provided in the circulation path;

a second heat exchange device provided into the circulation path in parallel to the first heat exchange device; and a valve configured to distribute the coolant flowing through the circulation path to each of the first heat exchange device and the second heat exchange device, and change a ratio of the distribution to each of the first and second heat exchange devices, wherein the electronic control unit is configured to further execute processing for determining a presence or absence of a heater request, processing for controlling the valve into a first mode in which an amount of the distribution to the first heat exchange device has a first priority when the heater request is present, and processing for controlling the valve into a second mode in which the distribution to the second heat exchange device takes priority over the distribution to the first heat exchange device when the heater request is absent.

* * * * *